US008398497B2

(12) United States Patent
Crawford et al.

(10) Patent No.: US 8,398,497 B2
(45) Date of Patent: Mar. 19, 2013

(54) TWISTER RIDE SYSTEM

(75) Inventors: David W. Crawford, Long Beach, CA (US); Edward A. Nemeth, Hermosa Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 317 days.

(21) Appl. No.: 12/966,289

(22) Filed: Dec. 13, 2010

(65) Prior Publication Data

US 2012/0149480 A1 Jun. 14, 2012

(51) Int. Cl.
*A63G 1/28* (2006.01)
*A63G 1/00* (2006.01)

(52) U.S. Cl. ..... 472/45; 472/43

(58) Field of Classification Search ..... 472/27, 472/43–47, 59, 60, 135, 136
See application file for complete search history.

(56) References Cited

U.S. PATENT DOCUMENTS 2,229,966 A * 1/1941 Eyerly ..... 472/45
2,576,477 A * 11/1951 Powell ..... 104/76
5,964,665 A * 10/1999 Uemura ..... 472/45
6,488,590 B2 * 12/2002 Katayama ..... 472/90
6,872,144 B2 * 3/2005 Kroon et al. ..... 472/45

* cited by examiner

*Primary Examiner* — Kien Nguyen

(74) *Attorney, Agent, or Firm* — Marsh Fischmann & Breyfogle, LLP; Kent A. Lembke

(57) ABSTRACT

A ride system for rotating vehicles through a vertical plane or ride space about a common horizontal axis. The ride system includes an elongated support member with a longitudinal axis. The system includes a housing with a base and a frame supporting the elongated support member with the longitudinal axis spaced apart a distance from the base and such that the longitudinal axis is substantially horizontal. The system also includes a plurality of vehicle support assemblies hanging from the elongated support member. Each of the vehicle support assemblies includes an extension arm supporting a passenger vehicle at one end and attached to the elongated support member at a second end via a support coupling assembly. The support coupling assembly is configured to rotate the extension arm about the longitudinal axis, whereby the passenger vehicle is moved through a vertical plane orthogonal to the longitudinal axis.

22 Claims, 7 Drawing Sheets

TWISTER RIDE SYSTEM

BACKGROUND

1. Field of the Description

The present description relates, in general, to amusement park rides and other entertainment rides such as round rides, and, more particularly, to amusement or theme park round rides configured to position a vehicle at numerous locations through movement of a coupler (or vehicle coupling point) on an end of a support arm through an irregular motion profile. The support arm is attached at an opposite end to a central hub that is rotated about a central or rotation axis at two or more speeds.

2. Relevant Background

Amusement and theme parks are popular worldwide with hundreds of millions of people visiting the parks each year. Park operators continuously seek new designs for rides that attract and continue to entertain park visitors. Many parks include round rides that include vehicles or gondolas mounted on support arms extending outward from a centrally located structure that is rotated by a drive assembly. The passengers or riders sit in the vehicles (or guest/rider compartments) and are rotated by the drive assembly, which spins the hub structure about its central axis. In some of these rides, the passengers may operate an interactive device, such as a joystick in the vehicle, to make the support arm and their attached vehicle gradually move upward or downward within a limited, preset range such as by pivoting the support arm at its connection to the central hub. Some rides also allow the passengers to control the pitch of their vehicle.

Even with these added features, it is difficult to provide a round ride that attracts repeat riders because the ride experience is repetitive and predictable. For example, the support arm typically has a fixed length, and the vehicle is rigidly or pivotally mounted at a fixed location on the support arm. As a result, the radius at which the vehicle rotates about the central hub or rotation assembly does not vary much throughout the ride. This results in a motion profile with a generally fixed or constant radius and a fixed vertical path (e.g., the passenger may be able to use a joystick to move their vehicle up and down in a predefined arc).

Available round rides have a limited and very predictable set of ride dynamics, such as centripetal force applied to the vehicle and vehicle speed, which are unchanging or vary only within a small range. Further, in many of these compact ride systems, a leading or preceding vehicle may be positioned directly in front of the following or trailing vehicles, which obstructs the riders sightlines as the range of relative motion between adjacent vehicles is fairly limited (e.g., the arm may pivot up and down on the hub through a small range of less than 45 degrees or the like).

While predictable in their experience, round rides are attractive to park operators because of their smaller footprint (compared with coaster and similar thrill rides) and lower maintenance and operating costs as well as simple control systems. Hence, there remains a need for new rides with enhanced ride experiences such as rides with more rider interactivity/control and larger ranges of ride dynamics but with fixed or smaller footprints or space requirements.

SUMMARY

The present description teaches a twister ride system in which each passenger vehicle is supported at the end of a rigid extension arm. At the opposite end, the extension arm is pivotally coupled to a support member (e.g., a horizontal or angled rod, pole, cylinder, or the like) that is supported above the ground and fixed in its location. The vehicle may include a user input device (e.g., a touch screen, a joystick, a steering wheel, a brake handle, or the like) that allows vehicle passengers to control the amount of pivoting experienced by their vehicle and/or such pivoting may be controlled by a ride controller, e.g., to synchronize vehicle movement with show elements provided on the ride housing or show projection surfaces adjacent or surrounding the support member (or "fixed-length and position track").

The extension arm is typically rigid and fixed length and the pivoting about e support member coupling causes the vehicle to move in a vertical plane about the longitudinal axis of the support member (typically, but not necessarily, all vehicles share a common rotation axis). Such pivoting may provide a complete rotation (e.g., 360 degrees about the rotation axis) or some smaller angular pivoting (e.g., 270 degrees, 180 degrees, or the like), and the vehicle may be supported upon the end of the extension arm in a fixed position, to counter rotation to retain the passenger compartment in a fixed horizontal orientation, or with some full or partial roll (which also may be controlled by the passenger in some cases).

An advantage of the twister ride systems described herein is that they provide a new ride experience using relatively simple and low risk mechanisms, which can be adjusted or controlled to provide a range of experiences from family ride experiences to high thrill experiences. The twister ride systems typically include at least some degree of passenger control and/or interactivity (e.g., trigger rotation or sweeping of the vehicle extension arm about the horizontal support). Some of the twister rides described below incorporate show and/or gaming features that are not typically found in round rides such as displaying a moving target on a ride projection surface that gains the rider points or a differing ride experience when flown over or providing a dogfight-type experience with pairs of leading/trailing (or adjacent) vehicles that may include point rewards or changes in ride experiences (e.g., disable/enable or change movement of vehicle extension arm).

More particularly, a ride system is provided for rotating vehicles through a vertical plane or ride space. The ride system includes a support member with a longitudinal axis. The system also includes a housing with a base and a frame supporting the support member with the longitudinal axis spaced apart a distance from the base and such that the longitudinal axis (or vehicle rotation axis) is substantially horizontal (e.g., relative to the base or a passenger loading platform). The vehicle support assembly includes an extension arm supporting a passenger vehicle at one end and attached to the support member at a second end via a support coupling assembly. The support coupling assembly is configured to rotate the extension arm about the longitudinal axis. For example, in some embodiments, the extension aim is rotated 360 degrees about the longitudinal axis by the support coupling assembly in either (or both) directions, whereby the passenger vehicle is moved through a vertical plane orthogonal to the longitudinal axis.

In some cases, the support coupling assembly may include a drive motor operable in response to control signals from an input device in the vehicle or from a ride control system to rotate the extension arm about the longitudinal axis. Also, in some embodiments, the ride system further includes a drive mechanism rotating the support member about the longitudinal axis. In such embodiments, the support coupling assembly may include a clutch selectively engaged by operation of an input device in the vehicle to engage the rotating support member to rotate the extension arm about the longitudinal axis.

In some ride systems, the housing includes display surfaces extending along a length of the support member. In these embodiments, the ride system may further include devices for displaying motion-simulating images upon the display surfaces that include elements that move past each of the vehicle support assemblies to simulate movement of the passenger vehicles (e.g., in a direction parallel to the longitudinal axis). Additionally, the passenger vehicle may include a body and a vehicle mount assembly coupling the body to the end of the extension arm. The vehicle mount assembly may be configured to control the amount of roil of the body relative to a roll axis extending through the body and being transverse to a longitudinal axis of the extension arm. In some embodiments, the vehicle mount assembly provides counter rotation of the body about the roll axis to maintain an orientation of the body, but, in other embodiments, the vehicle mount assembly provides roll of the body about the roll axis of at least 30 degrees relative to an orientation at loading/unloading (such roll may be controlled, in some cases, by a passenger operating a vehicle-based input device).

DETAILED DESCRIPTION

Figure 1:
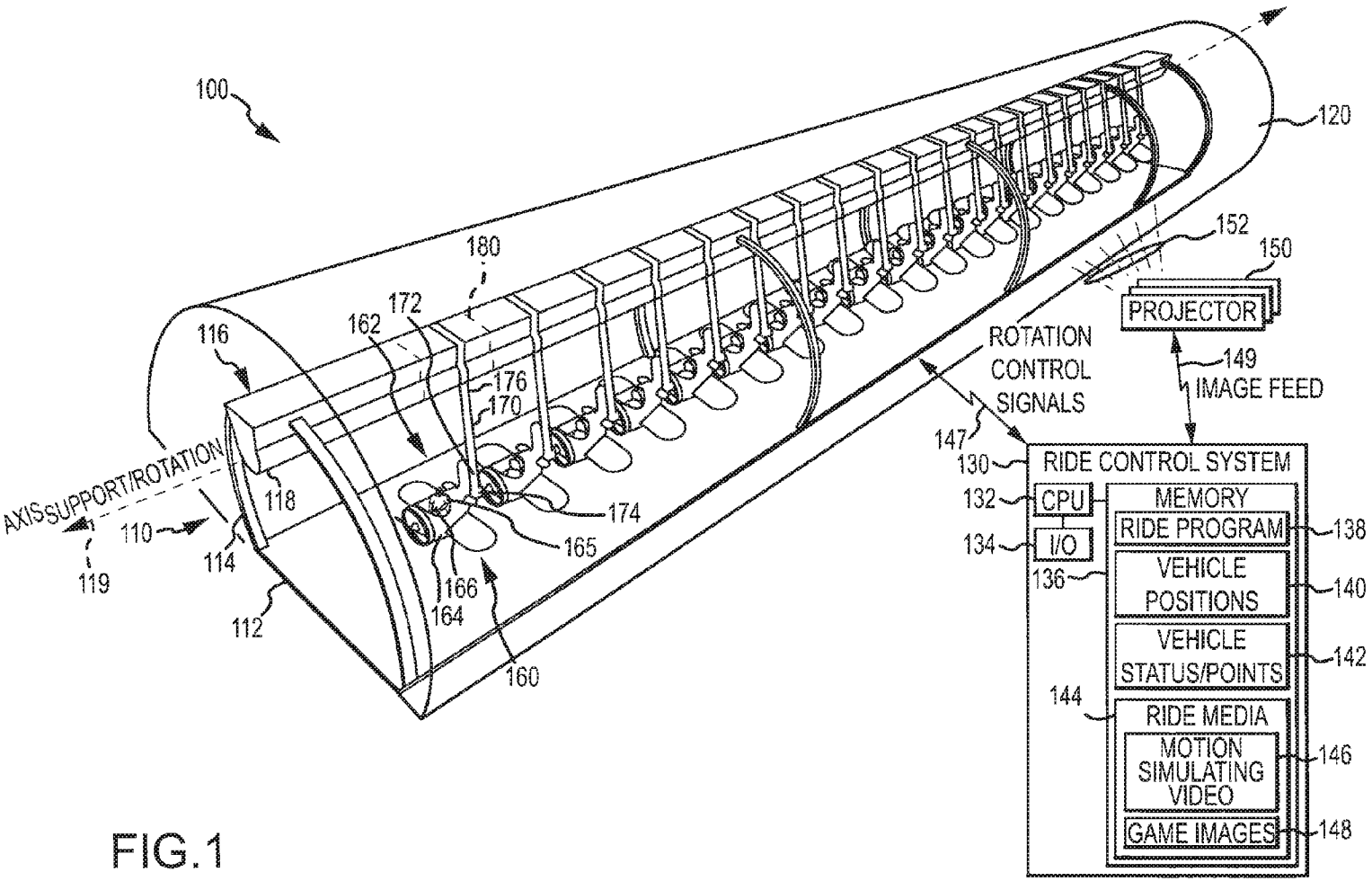
FIG. 1 is a perspective view of a twister ride system showing a plurality of passenger vehicles in the load/unload position and showing some aspects schematically including a ride control system and a set of projectors.

The description is generally directed to a twister ride system for use in providing a unique amusement or theme park ride experience in which a vehicle is able to laterally rotate in a vertical plane about a horizontal rotation axis. One preferred embodiment includes multiple, independent vehicles with some common elements in the horizontal support assemblies but, of course, providing multiple vehicles is not required to practice the invention. Each vehicle may be nearly any type of passenger compartment that is attached to an outer end of a rigid extension or support arm. The extension arm is, in turn, connected at its inner end to a horizontal support member via a pivotal support coupling assembly such that it can rotate in a vertical plane about a longitudinal or horizontal axis (a ride rotation or support axis). The horizontal support member is fixed in place or stationary, with the ride being a twister ride since the vehicles are rotated about the horizontal axis.

The connection to the fixed support structure and the length of the extension arm supporting the vehicle are such that the vehicle can safely rotate continuously (e.g., a 360 degree rotation about the horizontal axis) in either direction (clockwise (CW) or counter-clockwise (CCW)). A passenger controlled mechanism may be provided for each vehicle that, when activated, results in the rotation of the vehicle about the horizontal axis defined by the fixed support structure. For example, a user input device in the vehicle may be operated by a passenger to cause a drive motor of the support coupling assembly to rotate the extension arm CW or CCW about the support.

The twister ride system allows passengers or riders to control their rotation about a horizontal axis so as to swoop around the horizontal support, to pass over the top of support, to vertically climb and then drop, to pull elevated Gs. The twister ride system provides a ride experience that has different dynamics for each part of the circular path, is passenger-directed, and allows passengers of the vehicles to encounter a wide variety of dynamics. Further, the inventors believe that the passenger-controlled movement, including rotation in a vertical plane, through the ride space is distinctly unique.

Attraction concepts or features include enclosing the ride system within a tunnel-like environment (or ride housing) with inward facing projection surfaces. Video images are projected upon the front or rear walls of this tunnel-like housing to produce a sensation of forward motion and/or gross rotation even though the vehicles are not moving linearly down the fixed-location horizontal support. Gaming features may be included in a twister ride system including interaction between adjacent vehicles. For example, a trailing vehicle may be able to shoot/strike the leading vehicle in front of them so as to be able to momentarily disrupt the operation of the vehicle such as by altering their rotation mechanism to cause a quick drop (or otherwise having their operations affected by a trailing/chasing vehicle). In other cases, a scoring game may be provided in the twister ride system in which points are gathered by lining up with visual targets provided in the projected or displayed media along the adjacent projection surfaces or tunnel-like housing walls as their vehicle "passes" through the displayed/projected environment.

Several methods may be used to provide the rotation of the extension or support arm about the horizontal support member or column. One option provides a rotation mechanism in the support coupling assembly that includes a drive motor for each vehicle/arm. The driven rotation of the vehicle in the vertical plane, in such cases, may be in either direction (i.e., CW or CCW) and provides a very modularized design in which each vehicle support assembly (arm, vehicle, and support coupling assembly) may be independently installed and operated (or operation may still be synchronized or controlled by the ride control system).

A variation would be to provide a passenger-initiated clutching coupling device that makes contact with a horizontal support member (or shaft) that is rotating about the support or rotation axis of the ride system. In this variation or embodiment of the ride system, the clutching mechanism may be configured to not have sufficient engagement with the spinning horizontal support to pull a vehicle from the bottom of the vertical plane ride space to the top. In such an embodiment, the vehicle may still be able to do a full rotation but only by coordinated use and non-use (engaging and releasing) of the clutching mechanism by passenger to cause the vehicle to swing back and forth (CW and CCW) to obtain the necessary momentum to drive the vehicle over the top (e.g., the big "payoff" for some passengers of the ride system). The ride system may range in size from a horizontal support supporting a small number of vehicles (e.g., 5 to 10 or more) to one with a large number of vehicles (30 to 100 or more).

Several options or techniques may be used for coupling the vehicle to the outer end of the extension or support arm. One option is to attach the passenger compartment or vehicle to the extension arm through a fixed connection such that the guest compartment is fully inverted at the top of the ride space (e.g., when the vehicle is rotated 180 degrees from a bottom or load/unload position, the vehicle is upside down). A second option is to attach the compartment to the extension arm's outer end through a freely rotating connection such that the compartment remains essentially upright regardless of the orientation of the extension arm relative to the horizontal support or rotation axis of the ride system. A third option is to attach the vehicle to the extension arm through a limited rotation connection to create some predefined amount of roll but without full inversions. A fourth option is to attach the vehicle to the extension arm through an independently powered and controlled mechanism (by the passenger or the ride control system) such that the vehicle may roll to any orientation at any angular rotation position of the extension arm about the rotation or support axis of the ride system.

FIG. 1 illustrates a twister ride system 100 according to one embodiment and shown in a load/unload operating state (e.g., with vehicles at a lowest location for ready passenger entry and exit from passenger compartments). The system 100 includes a housing 110. The housing 110 includes a base or floor 112 upon which passengers may walk to reach vehicles (such as vehicle 162). Vertical structural supports 114 extend upward from the base 112.

The housing 110 includes walls 120 that define a tunnel-like housing for the ride system 100 with walls 120 extending over the supports 114 and spaced apart from an upper portion to allow room for the vertical rotation of the vehicles (such as vehicle 162) up to 360 degrees (or fully) about a horizontal support or rotation axis 119. The walls 120 are shown clear in this case to allow a view of the interior spaces of the defined ride space, but the walls 120 typically would be formed to provide projection surfaces (front or rear projection material and the like) for projected or displayed images 152 from projectors 150. The images 152 are selected to create a sensation of movement (e.g., forward movement) for passengers within the housing 110, even though the components of the housing 110 generally are stationary or fixed in position (or at least in linear location), such as with videos moving past the supported vehicles (such as vehicle 162).

The housing 110 further includes a horizontal support member assembly 6 supported and/or attached to the upper ends of the supports 114. The assembly 116 functions to support a horizontal support member or column 118 that runs the length of the ride system 100. The member 118 may be circular in cross section or another useful shape (or even a "useless" or improbable shape), and, more importantly, the member 118 is an elongated support that typically is arranged to be horizontal (e.g., in a plane parallel to base 112). A longitudinal axis 119, $\text{Axis}_{Support/Rotation}$, of the member 118 defines a horizontal axis that is a common rotation axis for a plurality of vehicles in the ride system 100, and the member 118 is fixed in place upon the supports 114 in that it does not move along the axis 119 although some embodiments call for the shaft/member 118 to rotate about the axis 119 to facilitate rotation of vehicles about the axis 119 in a vertical plane orthogonal to axis 119.

To this end, the ride system 100 includes a plurality of vehicle support assemblies such as exemplary assembly 160. The vehicle support assemblies are shown in FIG. 1 to be in a lowest or load/unload configuration with all the vehicles in-line and proximate to the base 112. The vehicle support assembly 160 includes a vehicle or passenger compartment 162 with a body 164 adapted for seating and safely retaining a passenger 165. The vehicle body 164 also includes an input device 166 that may be operated by the passenger 165 to control operation of a support coupling assembly 180 to control rotation about the axis 119 and/or to control roll of the body 164 via vehicle mount assembly 174.

Significantly, the vehicle support assembly 160 includes an extension or support arm 170. The arm 170 is attached at a first or outer end 172 to the vehicle body 164 via a vehicle mount assembly (or roll control mechanism) 174, which is operable to fix or provide an amount of roil of the body 164 relative to an axis extending through the body 164 orthogonal to the longitudinal axis of the arm 170. The arm 170 is attached at a second or inner end 176, opposite the outer end 172, to horizontal support member 118 via a support coupling assembly 180, which is operable by the vehicle input device 166 and/or a ride control system 130 (with control signals 147) to rotate the arm 170 about axis 119. In some embodiments, the support coupling assembly 180 is adapted to rotate the arm 170, and the connected vehicle 162, 360 degrees in a CW and/or CCW direction about the horizontal axis 119. The arm 170 generally is a rigid, elongate member with a length that defines the size of the vertical plane through with the vehicle 162 rotates (e.g., a circular plane with a diameter about equal to the length of the arm 170), which may be called a ride space for the vehicle 162.

In FIG. 1, portions of the ride system 100 are shown in functional block form to facilitate description of how a ride and its components may be controlled and operated. The ride system 100 is shown to include a ride control system or controller 130, e.g., a computer or electronic device using a combination of hardware and software to perform ride control functions such as to control operation of the support coupling assembly 180 and/or vehicle roll on the end of arm 172 via vehicle mount assembly 174. The control system 130 may include a hardware processor(s) 132 that manages operation of input/output devices 134 and memory/data storage 136 (e.g., computer readable media, digital data storage devices, and the like). The I/O devices 134 may include keyboards, mice, touchscreens/touchpads, monitors, printers, and the like that allow an operator of the control system 130 to input data/commands and to view ride data such as operating status of the ride including present positions of vehicles on motion profiles and hub rotation rates.

For example, an operator may initiate a ride program 138 (e.g., a software application, code, subroutines, and so on) that may define arm 170 rotation or body 164 roll. with signals 147 (that may be provided in a wired or wireless manner) and other ride parameters. The program 138 may define desired vehicle positions 140 for one or more of the vehicles 164 and may operate the support coupling assembly 180 to achieve these desired positions such as the load/unload positions shown in FIG. 1 at the beginning and end of a ride or operating cycle of system 100.

The ride program 138 may also track vehicle status/points in gaming operations of ride system 100 and, optionally, operate the support coupling assembly 180 (and, in some cases, the roll control mechanism 174) in response to detected or determined vehicle status 142. For example, a vehicle 164 may gain points by passing over targets or elements in displayed images 152 on wall 120 or base 112, and the ride program 138 may track these points 142. When a predefined number of points are gained, the support coupling assembly 180 may be operated 147 to modify the rotation of arm 170 (e.g., initially, allow only 90 degrees of rotation from load/unload position in CW and CCW directions and increase this to 180 degrees in both CW and CCW directions (or full rotation) when sufficient points are gained to move to the next level). In other cases, such as dogfights, the status 142 may be changed when the vehicle 164 is "tagged" by a trailing adjacent vehicle and the program 138 may define what signals 147 are to be sent to modify operation of assemblies 174, 180 (e.g., cause a sudden drop when tagged by operating coupling assembly 180 to rotate the arm 170 downward some angular amount from a current position, cause a vehicle to roll on end 172 when tagged, and so on).

The ride control system 130 also selectively transmits or provides an image feed 149 of digital media to projectors 150 to project/display 152 images on surfaces of wall 120 (base 112) to simulate linear motion of vehicle 162 in the direction (s) of the axis 119 (not just rotated vertically but given sensation of forward and/or rearward travel). The memory 136 may store ride media 144, which may include motion-simulating video(s) 144 and/or game images 148. The ride program 138 may define which images 146, 148 are shown and when during the ride operation of system 100. For example, the beginning and end of the ride may show images 152 on walls 120 that cause the passenger 165 to believe their vehicle 162 is not moving along the path of axis 119 while later in the ride the images may include video 146 that move or fly past the vehicle 162 so as to cause a feeling in the rider of forward (or rearward) or rotational movement along axis 119 (e.g., a first image may be displayed ahead of the vehicle 162 and then moved to be adjacent and then behind the vehicle 162 over time to emulate a particular linear velocity along the axis 119). Various projected show environments 152 may be used to provide desired amounts and directions of movement as well as gaming aspects. Physical features may also be moved past the vehicle 162 to enhance the forward or rearward movement sensation such as set features on conveyor belts or the like provided on base 112 or on/near inner surfaces of wall 120.

The ride 100 connects vehicles to a passenger-controlled (and/or ride control system 130-controlled) arm that is capable of rotating about a raised horizontal column 118. The rotation may be a full 360 degrees about the axis 119 (a longitudinal axis of column or shaft 118) or a lesser amount such as 180 to 270 degrees total (90 to 135 degrees each direction from that shown in FIG. 1). Each vehicle may be independently controlled to achieve a desired amount of rotation via operation of the support coupling assembly 180. Further, each vehicle 162 may be maintained, via operation and configuration of the vehicle mount assembly 174, at a constant orientation (e.g., via continuous counter rotation) or be allowed to provide a predefined limited amount of roll (less thrilling ride experience) or full roll (maximum thrill ride experience). As shown in FIG. 1, load/unload is conveniently accomplished with an in-line arrangement of the vehicles with the arms rotated about axis 119 to place the vehicles near a load/unload platform (e.g., base/floor 112 in the illustrated embodiment).

Figure 2:
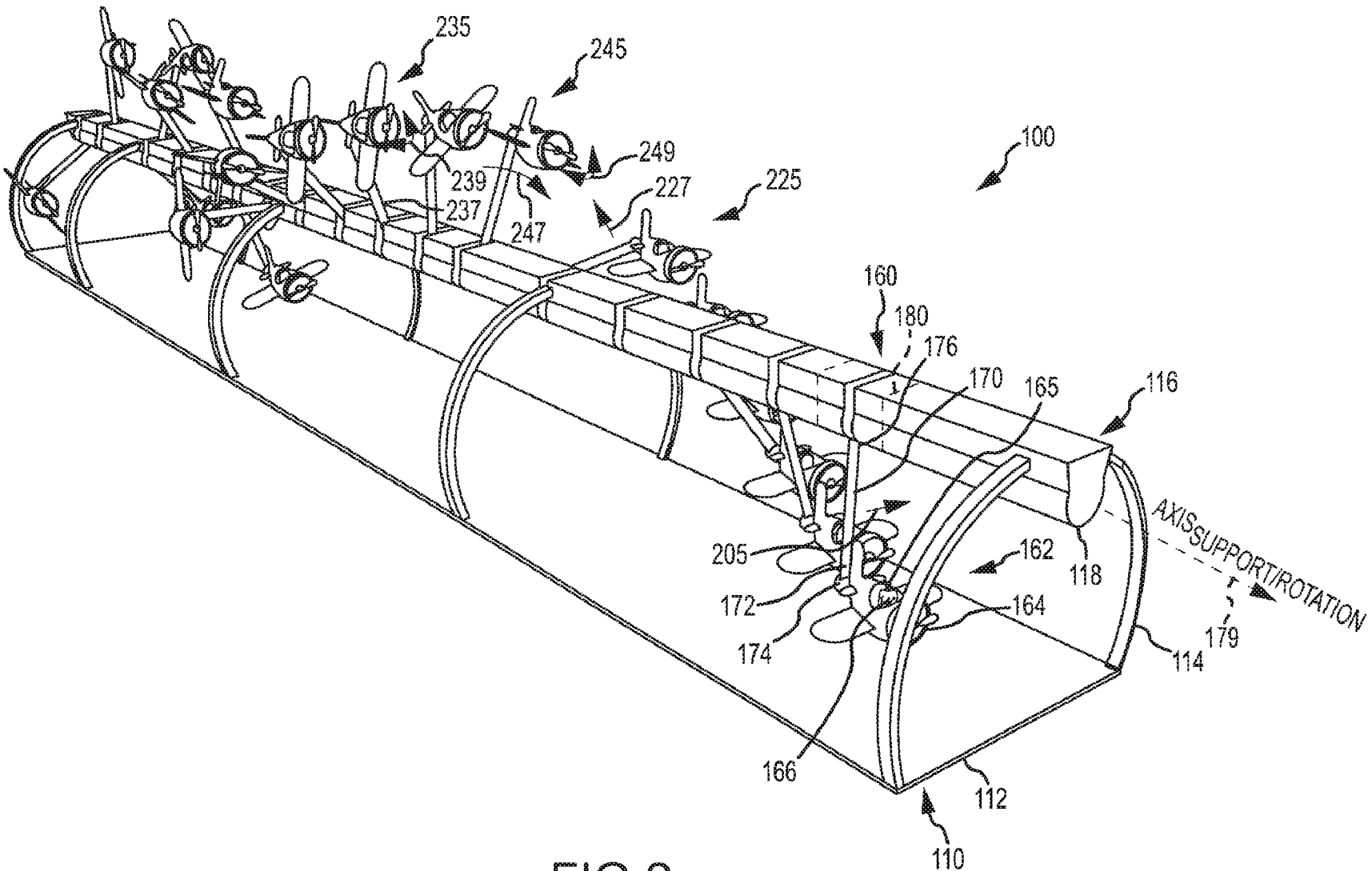
FIG. 2 is another perspective view of the twister ride system after loading showing the ride during operations in which vehicle assemblies are individually operated (e.g., by a ride control system and/or by passengers operating support coupling assemblies) to rotate passenger vehicles about a horizontal support member or column and within a vertical plane (e.g., rotation is restrained within a vertical plane transverse to a longitudinal axis of the horizontal support member)

FIG. 2 illustrates the ride system 100 after unloading/loading operations and during a forward motion simulation portion of the ride operations. As shown, the vehicle support assembly 160 is still in the load/unload or base/initial angular location of the arm 170 (magnitude of angular rotation about axis 119 is 0 degrees for vehicle 162). However, at this point, the ride controller or a passenger by operating the device 166 may operate the support coupling assembly 180 to cause the arm 170 to rotate in either a CW or CCW direction (in some embodiments the rotation may only be in one direction, while in others rotation may be in either direction) as shown with arrows 205.

The vehicle support assembly 225 is shown with its extension arm moving upward as shown with arrow 227 in a CCW direction (looking down along axis 119 at the front of the vehicles on horizontal support 118). As illustrated, the arm of the assembly 225 has rotated about 90 degrees CCW from the load/unload or initial position shown for assembly 160. The vehicle support assembly 225 has a vehicle mount assembly 174 that operates to maintain the orientation of the vehicle body relative to the base 112 such as with counter rotation to eliminate or nearly eliminate roll of the vehicle body. In contrast, the vehicle support assembly 235 is shown to have been rotated 237 over the top of support 118 (e.g., over 180 degrees of CCW rotation) and to have vehicle mount assembly configured to provide a high-thrill roll DOF. In this example, the vehicle mount assembly is adapted to allow a large amount of roll (e.g., a roll of nearly 90 degrees is shown with arrow 239). Further, thrill may be provided by locking or fixing the vehicle on the arm such that it "rolls" or is rotated proportional to the arm rotation (e.g., roll of 90 degrees such that vehicle is on its side when the arm is rotated 90 degrees from the load/unload position and 180 degrees such that the vehicle is upside down when the arm is rotated 180 degrees to be above the support member 118). A smaller amount of roll DOF may be provided to provide a more tame or less thrilling ride experience as shown with arrow 249 for vehicle support assembly 245, which is shown with arrow 247 to be rotating in a CW direction and to have a roll or banking magnitude of about 30 degrees (e.g., the roll could be held below some maximum amount such as 30 to 45 degrees to provide a thrilling but more family-oriented experience). Other implementations may give passengers full control over the vehicle roll actuator in order to give any 360-degree vehicle orientation relative to the arm position.

Figure 3:
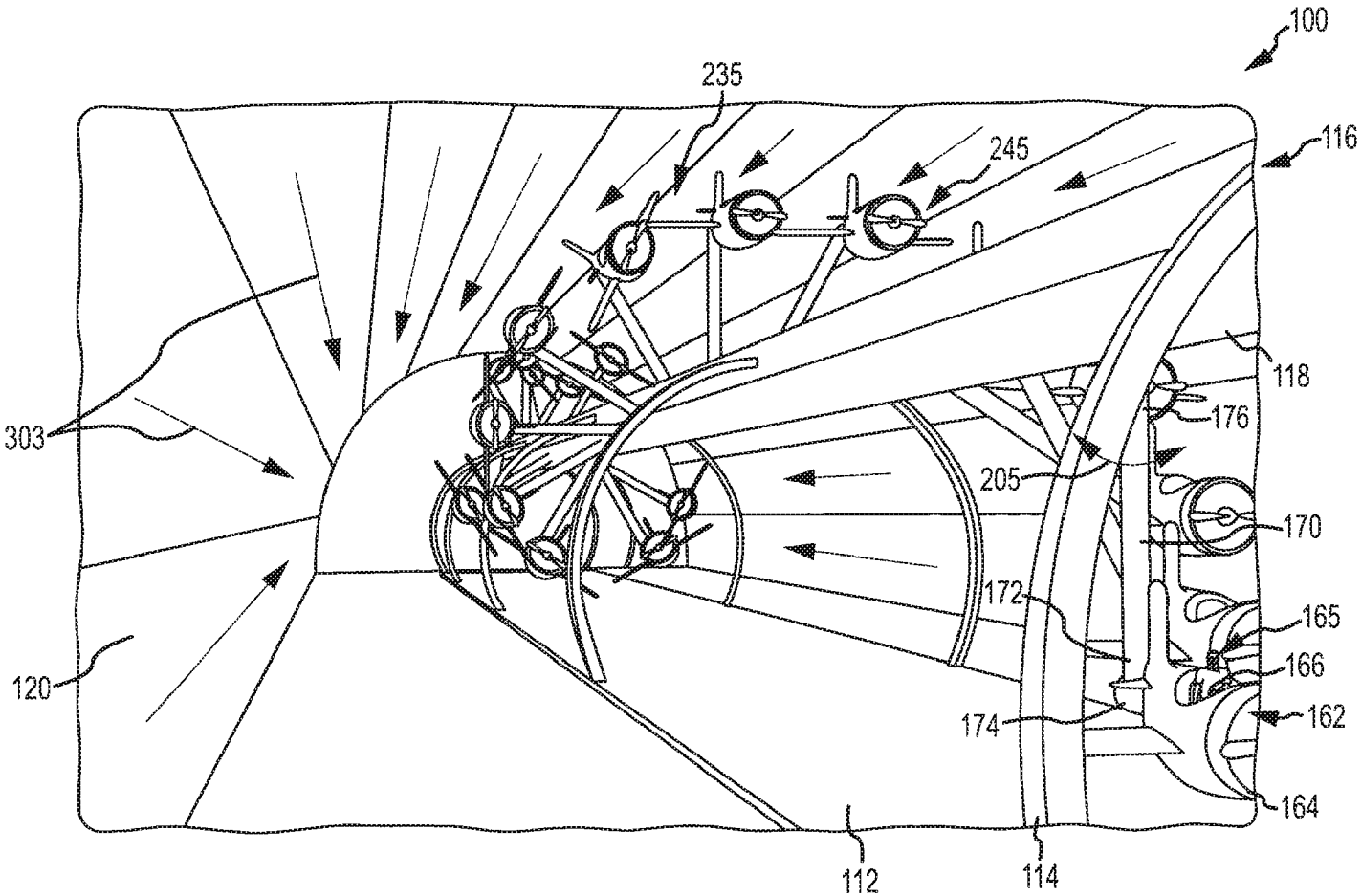
FIG. 3 illustrates the twister ride system of FIGS. 1 and 2 from within the ride housing with visual cues moving along the surfaces/walls surrounding or containing the ride to give the sensation of forward movement or flight along a path coinciding with the axis of the horizontal support member or column.

As discussed with reference to FIG. 1, the sensation of movement along the horizontal rotation axis of the ride system may be achieved by displaying images (or video) upon the walls or surfaces adjacent the vehicles that moves past the vehicles. FIG. 3 illustrates the ride system 100 from within the housing 110 with the inner surfaces of the housing wall 120 functioning as or being used as display or projection surfaces. The video displayed on the projection surfaces or walls 120 may include images that move, as shown with arrows 303, down the walls generally following a travel path parallel to the axis 119 such that a passenger in a vehicle in one of the vehicle support assemblies 160, 225, 245 will have the sensation of forward (or rearward) motion. The rate of this "motion" can be varied by choosing and changing the rate of movement 303 of the displayed images on wall 120. For example, if a displayed tree moves past your vehicle at 10 miles per hour, you (as a passenger) will have the sense that you (instead of the tree image) are moving at 10 miles per hour. Much faster speeds may be provided for images 303 to simulate flight. The sensation may be enhanced by generating wind within the inner space/tunnel of walls 120 that moves along the axis 119 into the fronts or oncoming vehicles.

Figure 4:
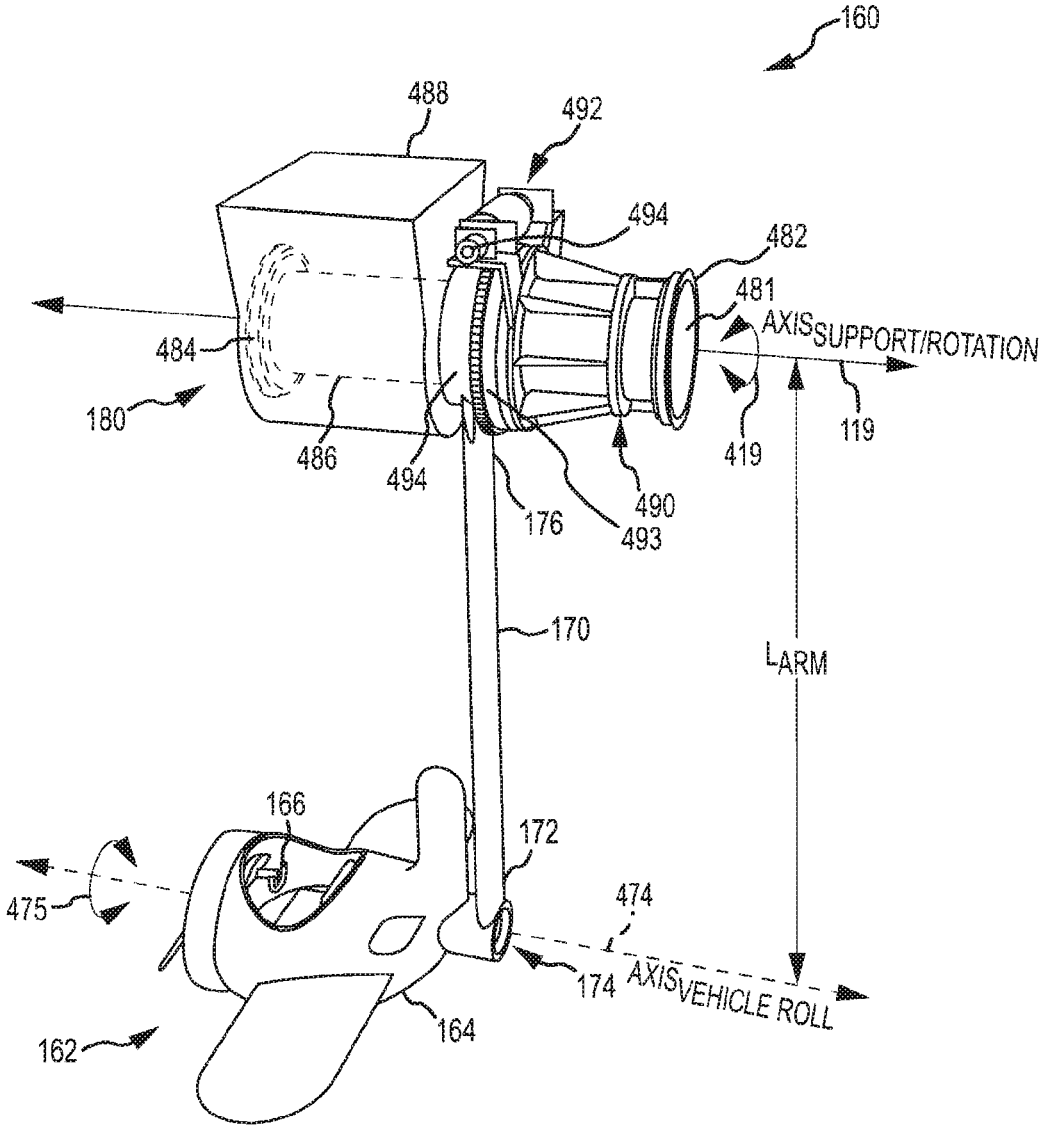
FIG. 4 illustrates a side view of one embodiment of a vehicle support assembly that may be used in the twister rides of the present description such as in the twister ride systems of FIGS. 1-3.
Figure 5:
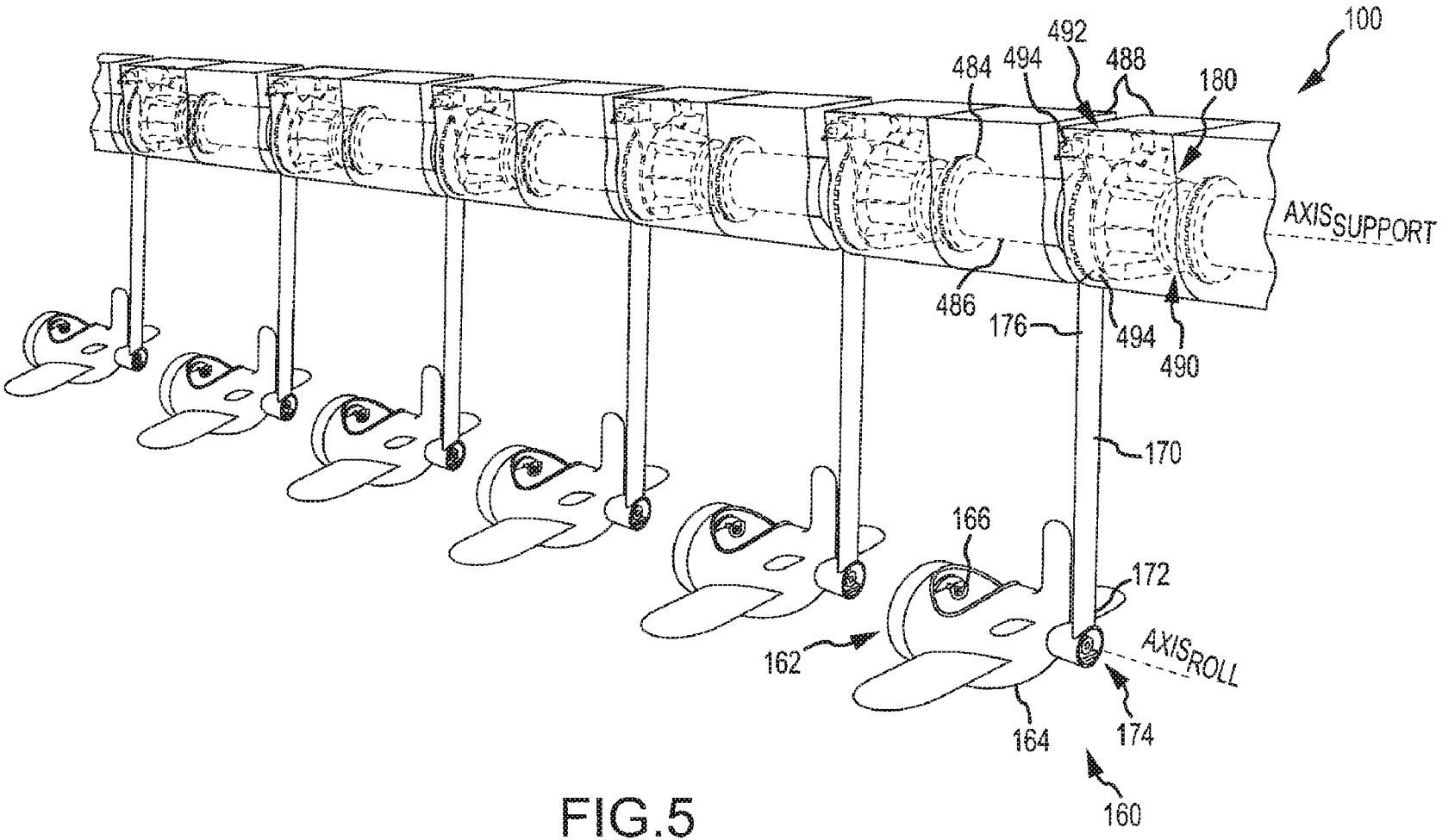
FIG. 5 illustrates a rear perspective view of the twister ride system of FIG. 1 in which the vehicle support assemblies are provided in the form shown in FIG. 4 and rely on adjacent support assemblies to provide structural support for the assembly.

The ride system 100 may be scalable and/or provide for ready installation and repair by providing a modular design for the vehicle support assemblies. For example, FIGS. 4 and 5 illustrate a flange-mounted arrangement for the vehicle support assembly 160. In this embodiment, the assembly 160 includes a support coupling assembly 180 in the form of an individually driven slew bearing that allows continuous passenger or ride control system control over the position/motion of the vehicle body 164. Specifically, the coupling assembly 180 includes a rear mounting flange 482 and front mounting flange 484 allowing adjacent ones of the support assemblies 160 to be interconnected as shown in FIG. 5 to define the common rotation or support axis 119. The coupling assembly 180 may include a sleeve 486 and a collar that slide over the horizontal support member or column 481. In other cases, though, the sleeve 486 is simply an extension of the column 481 from collar 490 with the combination of two or more of the support coupling assemblies 180 defining the horizontal support member 118 of FIG. 1 and its rotation axis 119. One or more covers or enclosures 488 may be provided to protectively encase the coupling assembly components (and/or hide their presence from passengers in vehicle 162.

The coupling assembly 180 includes a gear assembly 492 to rotate a slewing gear or body 494 about the axis 119 as shown with arrow 419. The arm 170 is rigidly attached to the gear or body 494 to rotate 419 with it about axis 119 and cause vehicle 162 to also rotate and move in a vertical plane orthogonal to the axis 119. The gear assembly 492 includes a bearing and gear assembly 493 (such as a slew bearing and gear assembly) that is attached on its inner portion to the support column or member 481 and presents gear teeth to a vehicle arm rotation drive motor 494 that causes the gear or body 494 to rotate 419. The drive motor 494 may operate in response to control signals from the ride control system and/or from the input device 166 in the vehicle 162 to rotate the vehicle 162 in one or both directions (CW or CCW) about axis 119 and at a constant or range of speeds. In some cases, the rotation 419 is full (360 degrees about the axis 119) while in other cases stops or operation of the motor 494 may be used to define the magnitude of the angular rotation 419 about axis 119. The length, $L_{Arm}$, when combined with the magnitude of the rotation 419 defines the ride space for the vehicle body 164, and the length, $L_{Arm}$, typically will range from about 10 to 20 feet or more.

The vehicle body 164 is connected to the end 172 of the extension arm 170 with a vehicle mount assembly 174. The assembly 174 may allow no rotation or roll of the vehicle body 164 about the roll axis 474 (an axis passing through the body 164 and assembly 174 transverse to the longitudinal axis of the arm 170 (e.g., orthogonal to the arm 170 in some cases)). In other cases, though, the assembly 174 is configured to roll 475 the vehicle about the roll axis 474 in response to rotation 419 of the arm 170 about the common horizontal axis 119. The mechanism 174 may be adapted to provide proportional counter rotation to keep the body 164 in the initial horizontal orientation while it may be allowed to roll 475—freely or in a driven manner—to provide more thrill (such as up to 180 degrees or more of total roll 475).

Figure 6:
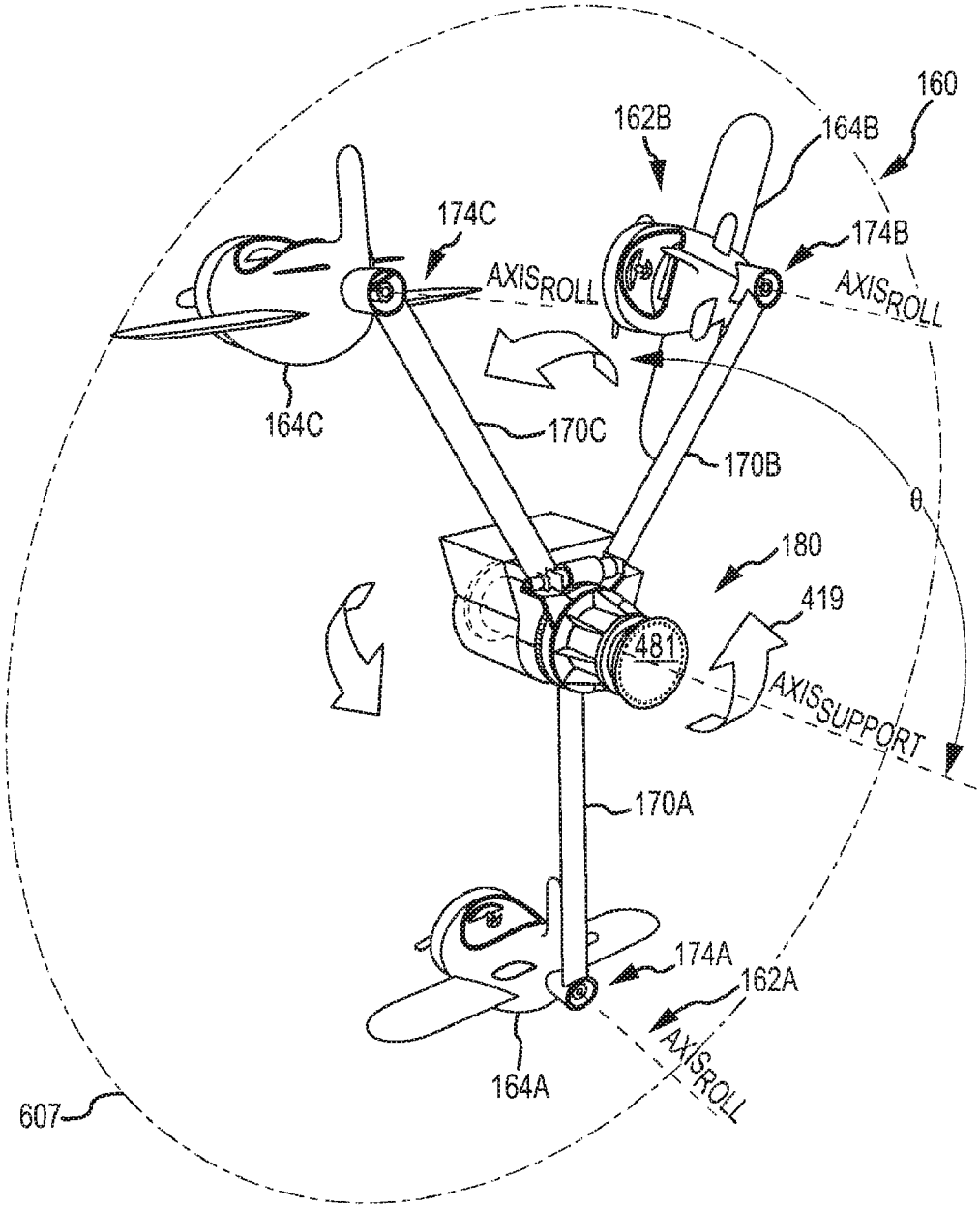
FIG. 6 illustrates a vehicle support assembly as shown in FIG. 4 but with a vehicle support or extension arm rotated to three differing positions about the axis of the horizontal support member or column.

The degrees of freedom of the vehicle of support assembly 160 are shown in more detail in FIG. 6. As shown, the vehicle 162A is shown in an initial or load/unload orientation or position. The vehicle 162A has its body 164A in a load/unload orientation (e.g., compartment horizontal or parallel to a base/floor) when the arm 170A is directly below the coupling assembly 180. The vehicle 162A is shown to move within or rotate through 419 a ride space or vertical plane 607 to a second orientation shown with vehicle 162B, and the rotation 419 is about the support axis 119. The vertical plane 607 is at an offset angle, θ, from the support or common horizontal axis 119 such as 90 degrees or some other angle when the plane 607 is not orthogonal to the horizontal support 481. The arm 170B has moved or swept 410 through an angular movement about axis 119 of about 135 degrees in the CCW direction. The vehicle mount assembly 174B is adapted to provide a significant amount of roll about the roll axis, $Axis_{Roll}$, that extends through the vehicle body 164B. For example, the amount of roll may be 30 to 180 degrees (or about 70 to 90 degrees as shown when the arm 170B has rotated about 135 degrees from the original or initial orientation at 170A).

In contrast, the vehicle body 164C is still horizontal (or in the initial or load/unload orientation) even after its support arm 170C has rotated over the top of support 481. This is achieved by configuring vehicle mount assembly 174C to provide counter rotation about the roll axis, $Axis_{Roll}$, such that the vehicle body 164C is still horizontal (or some other initial orientation) regardless of the arm 170C angular location (such as 225 degrees of CCW rotation as shown in FIG. 6). As discussed above, the vehicle mount assembly 174A-C may take the form of a free bearing that keeps the center of gravity under pivot with some free oscillation (such as for coupling 174B), may take the form of a mechanical coupling that is adapted to ensure constant orientation during arm rotation (such as for coupling 174C), and/or may take the form of an electric motor or driver that is driven based on passenger control via an input device on the vehicle and/or based on ride control system control signals (e.g., to follow a specific show profile that may define the vehicle roll amount on arm 170).

Figure 7:
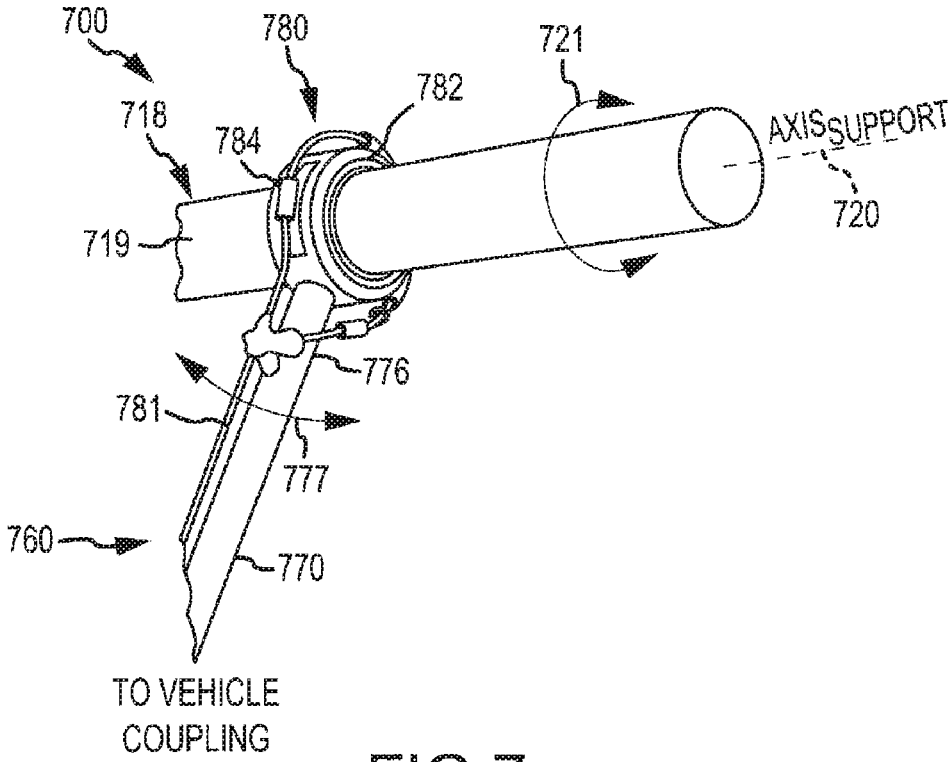
FIGS. 7 and 8 are partial perspective and end views, respectively, of another embodiment of a twister ride system showing use of a combination of a rotating horizontal support shaft/member with a passenger-initiated clutch-type support coupling assembly for selectively engaging the support shaft to cause the vehicle to rotate about the support axis.
Figure 8:
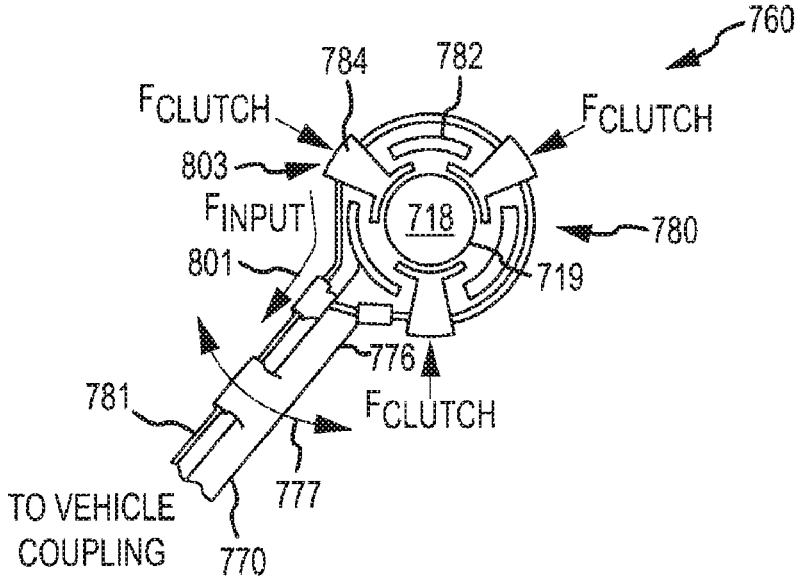

With the vehicle coupling assembly 180 shown in FIG. 4 understood, it will be apparent to those skilled in the art that many other configurations may be used to practice the invention. For example, FIGS. 7 and 8 illustrate a portion of another twister ride 700 in which a horizontal support member 718 is provided for supporting vehicle support assemblies such as assembly 760. The horizontal support member 718 is rotated about its central axis (i.e., the common horizontal axis for the ride's vehicles) as shown with arrow 721. This is in contrast to the previously described embodiments in which the horizontal support was stationary. As a result, the outer surface 719 is moving at one or more rates past surfaces and components used to "hang" the vehicle support assembly 760 on the member 718.

To this end, the vehicle support assembly 760 includes an extension arm 770 that supports a vehicle mount assembly on one end (not shown but as described for ride 100) and on a second or inner end 776 is connected to a support coupling assembly 780. The support coupling assembly 780 may be described as a clutch coupling to a constantly rotating center column 718. Such a connecting assembly 780 allows for vehicle passengers to control coupling between the vehicle and the center shaft 718 via a clutch driving cable or brake line 781 that extends along the arm 771 to a vehicle and an input device that applies an input or coupling force, $F_{Input}$. The coupling assembly 780 is adapted to allow for minimal power and control systems.

As shown, the coupling assembly 780 includes a clutch or collar assembly 782 extending about the horizontal support member 718 with brake or clutch pads proximate to the outer surface 719. The assembly 780 further includes brake line 781 guides 784, and when the line 781 is pulled by a vehicle-based input device as shown with arrow 801 the lines 781 extending through guides 784 collapse to apply a clutching or braking force, $F_{Clutch}$, 803 to cause pads of clutch assembly 782 to engage the moving surface 719 of the horizontal support 718. As a result, the arm 770 is rotated 777 with the spinning shaft 718. The friction between the pads and the surface 719 may not be adequate to pull the arm 770 and an attached vehicle over the top of shaft/member 718, but this full rotation may still be achieved by swinging the arm 770 and attached vehicle back and forth 777 to gain momentum to cause it to swing up to and, in some cases, over the top of shaft 718 (e.g., selective engaging and releasing of clutch 782 with surface 719).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A ride system comprising:

a rotational support member with a longitudinal axis;

a housing with a base and a frame supporting the rotational support member with the longitudinal axis spaced apart a distance from the base, the longitudinal axis being substantially horizontal;

at least one vehicle support assembly hanging from the rotational support member, each of the vehicle support assemblies including an extension arm supporting a passenger vehicle at one end and being attached to the rotational support member at a second end via a support coupling assembly, wherein the support coupling assembly is configured to rotate the extension arm about the longitudinal axis of the rotational support member; and a drive mechanism rotating the rotational support member about the longitudinal axis, wherein the support coupling assembly includes a clutch selectively engaged by operation of an input device in the vehicle to selectively engage the rotational support member to rotate the extension arm about the longitudinal axis.

2. The ride system of claim 1, wherein the extension arm is rotated 360 degrees about the longitudinal axis by the support coupling assembly, whereby the passenger vehicle is moved through a vertical plane orthogonal to the longitudinal axis.

3. The ride system of claim 1, wherein the support coupling assembly comprises a drive motor operable in response to control signals from an input device in the vehicle or from a ride control system to rotate the extension arm about the longitudinal axis.

4. The ride system of claim 1, wherein the housing includes display surfaces extending along a length of the elongated support member and the ride system further includes devices for displaying motion-simulating images upon the display surfaces that include elements that move past each of the vehicle support assemblies to simulate movement of the passenger vehicles in a direction parallel to the longitudinal axis.

5. A ride system comprising:

a rotational support member with a longitudinal axis;

a housing with a base and a frame supporting the rotational support member with the longitudinal axis spaced apart a distance from the base, the longitudinal axis being substantially horizontal; and at least one vehicle support assembly hanging from the rotational support member, each of the vehicle support assemblies including an extension arm supporting a passenger vehicle at one end and being attached to the rotational support member at a second end via a support coupling assembly, wherein the support coupling assembly is configured to rotate the extension about the longitudinal axis of the rotational support member, and wherein the passenger vehicle includes a body and a vehicle mount assembly coupling the body to the end of the extension arm, the vehicle mount assembly configured to control an amount of roll of the body relative to a roll axis extending through the body and being transverse to a longitudinal axis of the extension arm.

6. The ride system of claim 5, wherein the vehicle mount assembly provides counter rotation of the body about the roll axis to maintain an orientation of the body.

7. The ride system of claim 5, wherein the vehicle mount assembly provides roll of the body about the roll axis of at least 30 degrees relative to an orientation at loading/unloading.

8. The ride system of claim 5, wherein the extension arm is rotated 360 degrees about the longitudinal axis by the support coupling assembly, whereby the passenger vehicle is moved through a vertical plane orthogonal to the longitudinal axis.

9. The ride system of claim 5, wherein the support coupling assembly comprises a drive motor operable in response to control signals from an input device in the vehicle or from a ride control system to rotate the extension arm about the longitudinal axis.

10. The ride system of claim 5, further including a drive mechanism rotating the rotational support member about the longitudinal axis and wherein the support coupling assembly includes a clutch selectively engaged by operation of an input device in the vehicle to engage the rotational support member to rotate the extension arm about the longitudinal axis.

11. The ride system of claim 5, wherein the housing includes display surfaces extending along a length of the elongated support member and the ride system further includes devices for displaying motion-simulating images upon the display surfaces that include elements that move past each of the vehicle support assemblies to simulate movement of the passenger vehicles in a direction parallel to the longitudinal axis.

12. A twister ride comprising:

a vehicle adapted for supporting a passenger;

a linear support member spaced apart a distance from with a longitudinal axis parallel to a ride base;

a support arm with a length less than the distance, the support arm coupled at a first end with the vehicle;

a coupling assembly coupling a second end of the support arm to the linear support member, the coupling assembly including a drive selectively operable to rotate the support arm about the longitudinal axis of the linear support member, whereby the vehicle is moved through a ride space that is vertical relative to the ride base;

a display surface extending adjacent the linear support member: and a display device operating to display video images that include elements moving, over a period of time, along the display surface past the vehicle.

13. The ride of claim 12, wherein the linear support member is stationary.

14. The ride of claim 12, wherein the displayed video images include game elements and wherein operation of the coupling assembly is controlled based on a location of the vehicle relative to the location of the game elements on the display surface.

15. The ride of claim 12, wherein the vehicle includes an input device operable by a passenger in the vehicle to operate the coupling assembly to selectively rotate the support arm about the longitudinal axis.

16. The ride of claim 15, wherein the support arm is rotated based on operation of the input device to rotate in the clockwise and the counterclockwise directions.

17. The ride of claim 15, wherein the support arm is rotated at least about 180 degrees about the longitudinal axis.

18. An amusement park ride, comprising:

a housing with a horizontal floor and a support frame;

an elongated support structure hung from the support frame at a distance above the floor, the support structure having a longitudinal axis parallel to the floor; and a plurality of vehicle support assemblies each comprising a rigid extension arm supporting a passenger vehicle at a first end and coupled, via a coupling assembly, to the support structure at a second end, wherein the coupling assembly of each vehicle support assembly is independently operable to rotate the extension arm about the longitudinal axis, wherein each of the vehicles is mounted to the first end of the extension arm to pivot about a roll axis extending through a body of the vehicle to provide at least 30 degrees of roll for the vehicle body.

19. The ride of claim 18, wherein the coupling assembly includes a drive motor selectively operable to rotate the extension arm about the longitudinal axis in response to control signals from a ride control system or from an input device positioned on the passenger vehicle.

20. The ride of claim 19, wherein the extension arm is rotated in both a clockwise direction and in a counterclockwise direction by the drive motor.

21. The ride of claim 18, wherein the extension arm is rotated through an angular range of motion of at least about 180 degrees during operation of the coupling assembly.

22. The ride of claim 18, wherein the housing includes display surfaces extending along the support structure and a display device displaying video images with elements that move in a direction parallel to the longitudinal axis past each of the vehicle support assemblies.

* * * * *

UNITED STATES PATENT AND TRADEMARK OFFICE

CERTIFICATE OF CORRECTION

PATENT NO. : 8,398,497 B2
APPLICATION NO. : 12/966289
DATED : March 19, 2013
INVENTOR(S) : David W. Crawford et al.

It is certified that error appears in the above-identified patent and that said Letters Patent is hereby corrected as shown below:

In the Claims, Column 11, line 60 through Column 12, line 13:

Please replace Claim 5 of the issued patent with the following rewritten claim.

--A ride system comprising:
a rotational support member with a longitudinal axis;
a housing with a base and a frame supporting the rotational support member with the longitudinal axis spaced apart a distance from the base, the longitudinal axis being substantially horizontal; and
at least one vehicle support assembly hanging from the rotational support member, each of the vehicle support assemblies including an extension arm supporting a passenger vehicle at one end and being attached to the rotational support member at a second end via a support coupling assembly,
wherein the support coupling assembly is configured to rotate the extension arm about the longitudinal axis of the rotational support member, and
wherein the passenger vehicle includes a body and a vehicle mount assembly coupling the body to the end of the extension arm, the vehicle mount assembly configured to control an amount of roll of the body relative to a roll axis extending through the body and being transverse to a longitudinal axis of the extension arm.--

Signed and Sealed this
Twenty-eighth Day of May, 2013

Teresa Stanek Rea
*Acting Director of the United States Patent and Trademark Office*